US006135169A

United States Patent [19]

Sandei et al.

[11] Patent Number: 6,135,169

[45] Date of Patent: Oct. 24, 2000

[54] AUTOMATIC CUPPED DRINKS DISPENSER

[75] Inventors: Pietro Sandei; Ugo Sandei; Stefano Sandei, all of Parma, Italy

[73] Assignee: Ducale Macchine Da Caffe' Di Sandei Ugo E C. S.N.C., Parma, Italy

[21] Appl. No.: 09/291,755

[22] Filed: Apr. 14, 1999

[30] Foreign Application Priority Data

Apr. 15, 1998 [IT] Italy ..... RE98A0039

[51] Int. Cl.[7] ..... B65C 43/42; B67C 3/00

[52] U.S. Cl. ..... 141/129; 141/135; 141/163; 141/165; 141/168; 141/171; 141/173; 141/174

[58] Field of Search ..... 141/129, 135, 141/163, 165, 168, 171, 173, 174; 221/207, 210, 221, 222, 223

[56] References Cited

U.S. PATENT DOCUMENTS

| | | | |
|---|---|---|---|
| 4,327,843 | 5/1982 | Corley | 221/210 |
| 5,074,341 | 12/1991 | Credle, Jr. et al. | 141/1 |
| 5,625,198 | 4/1997 | Chigira | 250/559.29 |

FOREIGN PATENT DOCUMENTS

| | | |
|---|---|---|
| 0014591A1 | 8/1980 | European Pat. Off. . |
| 0462591A1 | 12/1991 | European Pat. Off. . |
| 0732675A3 | 9/1996 | European Pat. Off. . |

*Primary Examiner*—Henry J. Recla
*Assistant Examiner*—Timothy L. Maust

[57] ABSTRACT

The dispenser comprises a plurality of delivery stations (20*a*–20*b*, 30) for the constituent substances of the drink, a delivery station (40) for empty cups, a location (10) for release of the drink to the user, and an automatic control unit which automatically controls the succession of operations involved in emitting the substances and cups. A cup handling device (60) is provided, comprising a gripping member (61) for gripping a cup (8), and means for moving said gripping member (61) in such a manner as to bring it, by a succession of movements, to the exit points of the delivery stations (20*a*–20*b*, 30, 40, 50); said handling device (60) is controlled by the automatic control unit in such a manner as to firstly bring the gripping member (61) to the station (40), then bring the gripped cup under the exit points of the other delivery stations (20*a*–20*b*, 30, 50), and finally bring the cup carrying the drink into the location (10) for its release to the user.

4 Claims, 5 Drawing Sheets

AUTOMATIC CONTROL UNIT
31
20a
20b
20c
20d
20e
20f
21
21
30
32
33
23
25
III
III
35
26
25
8
63
9

AUTOMATIC CUPPED DRINKS DISPENSER

BACKGROUND OF THE INVENTION

The present invention relates to automatic dispensers for cupped drinks, such as coffee, milk, chocolate, tea, syrups, soup and other drinks.

Cupped drink dispensers have been known for some time, comprising a plurality of delivery stations containing constituent substances of the drink and from which a substance is emitted in the fluid state (liquid or powder), and a cup delivery station. This latter station allows empty cups to fall (one at a time) into a user release location, from which the cup can be taken by the user after the constituent substances of the drink (for example a coffee infusion together with sugar and a little milk) have been fed into the cup lying in this location. The entire procedure is controlled by an automatic control unit which automatically controls the succession of operations involved in emitting the substances and cups.

The delivery stations are connected to the drink release location by various relatively lengthy pipes extending from the top downwards, which start from the exit points and all converge at the release location for the drink contained in the cup. Said pipes convey the substance leaving the exit point to the drink release location by gravity.

A drawback of said machines is the difficulty of periodically cleaning, as required by proper hygiene, all those machine parts which come into contact with the constituent substances of the drink, in particular the lengthy pipes which convey the substances to the cup positioned in the drink release location.

Another drawback is that droplets of other substances can undesirably fall into the drink in the release location from pipes relative to these other substances, and spoil the taste of the substance actually requested.

A further drawback is that certain substances, such as chocolate powder, or solid objects, cannot be lowered through said pipes.

A still further drawback is that the number of substance conveying pipes is limited by the fact that all these pipes must have their final opening lying within the upper circumference of the cup, the number of possible delivery stations consequently being limited.

SUMMARY OF THE INVENTION

An object of the invention is to provide an automatic dispenser which overcomes said and other drawbacks.

The present invention is based on the idea of providing a cup handling device comprising a gripping member for gripping a cup, and means for moving said gripping member in such a manner as to bring it, by a succession of movements, to the exit points of the delivery stations; said handling device is controlled by the automatic control unit in such a manner as to firstly bring the gripping member to the cup delivery station in order to grip a cup, then bring the gripped cup under the exit points of the other delivery stations, and finally bring the cup into the location for release of the drink to the user.

BRIEF DESCRIPTION OF THE DRAWINGS

The invention is described in detail hereinafter with the aid of the accompanying figures which illustrate a non-limiting embodiment thereof and wherein.

DETAILED DESCRIPTION OF THE INVENTION

Figure 1:
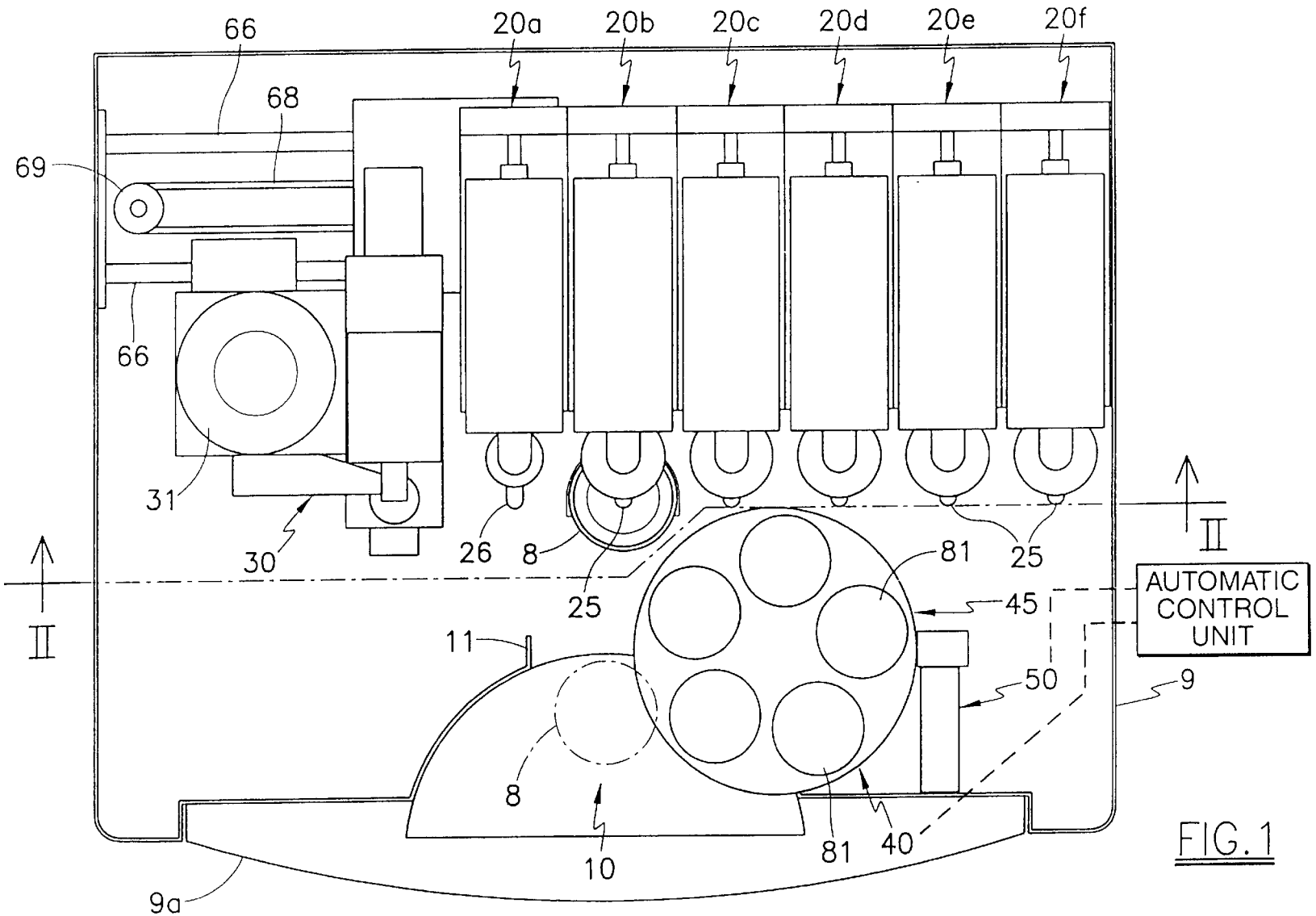
FIG. 1 is a plan view from above showing the members positioned within the dispenser.
Figure 2:
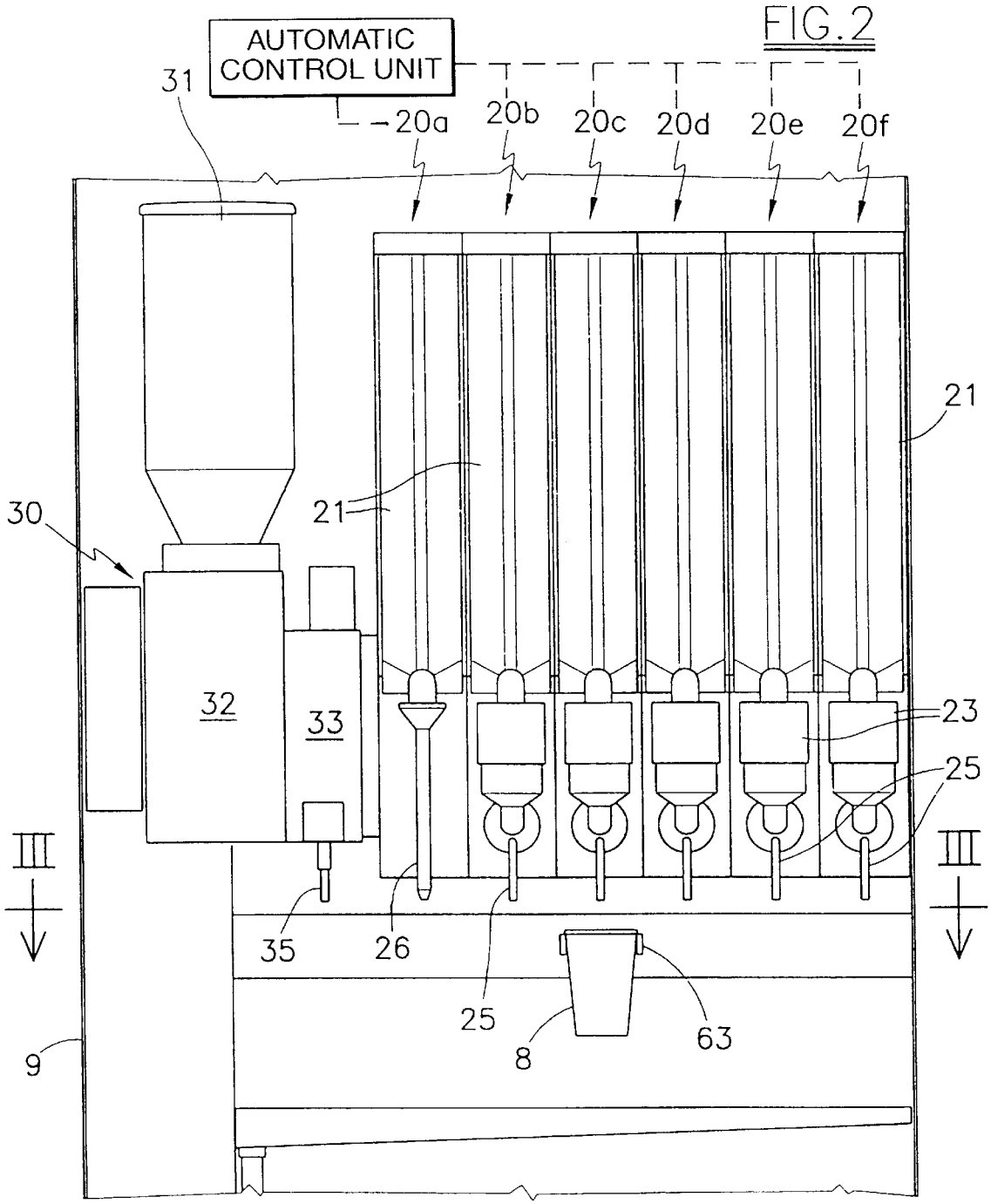
FIG. 2 is a section on the vertical plane II—II of FIG. 1.

The dispenser of the invention comprises an outer casing 9 enclosing within its interior substantially all the members of the dispenser, to conceal them and isolate them from the external environment. The drink is prepared within the casing 9 and then, contained in a cup, is placed in a user release location 10 which is provided in the front wall of the casing 9 and opens outwards (so that the user can take the drink with his hand), it also communicates with the casing interior via a window 11.

Inside the casing 9 there are positioned several delivery stations for the constituent substances of the drink. Said stations are substantially of known type and are therefore described summarily herein and illustrated schematically in the figures. Said stations can be of different type one from another and their number and the substances delivered by them can be different from that illustrated.

In the embodiment shown in the figures a number of structurally identical stations **20*a*–20*f* are provided to contain different substances in powder form, which are mixed with water and then delivered from respective exit spouts 25**.

Specifically, each of said stations **20*a*–20*f* (known type) comprises a vessel 21 able to contain a large quantity of substance in powder form. On the base of each vessel 21 there are positioned metering means, for example of screw type (not shown in the figures), arranged on command to emit a predetermined metered quantity of material in powder form. The metered material falls into an underlying mixing device 23 into which water is also fed to dissolve the powder. The liquid mixture obtained in this manner is finally emitted through the exit spouts 25 positioned in the lower region of the devices 23. In a typical (but not exclusive) application, said stations 20*a*–20*f* are arranged to deliver a mixture of water and powdered milk, liquid chocolate (obtained from chocolate dissolved in water), tea infusion (obtained from tea in powder form dissolved in water), orange infusion (obtained from freeze-dried orange dissolved in water) or other fruit infusion, soup infusion (obtained from freeze-dried soup dissolved in water) and other possible mixtures. One of said stations, for example the station 20*a*, is arranged to deliver powdered sugar. In this case the mixing device 23 is not provided, the sugar being emitted via a short tube 26 connected directly to the vessel 21**.

A station 30 (known per se) structurally different from the stations **20*a*–20*f*** is also provided, for delivering a hot espresso coffee infusion.

Said station 30 comprises a vessel 31 for coffee grains, which feeds an underlying grinding device 32. This then feeds a device 33 which produces with pressurized water an espresso coffee infusion which is delivered via an exit spout (not visible in the figures).

In the embodiment illustrated in the figures, the delivery stations **20*a*–20*f* and 30 are mutually aligned along the rear vertical wall, their exit points (ie the lower opening of the exit spouts, of the tube 26 and of the exit spout 35**) being mutually aligned along a straight line parallel to a first horizontal direction (parallel to the front wall).

Against the inner surface of the front wall 9*a* of the casing 9 there is provided a cup delivery station 40 (known per se) lying opposite the group of stations 20*a*–20*f*. In the embodiment illustrated in the figures, the station 40 comprises a rotary magazine 45 able to contain several columns 81 of (plastic) cups 8. In the base of the station 40 there is provided a cup exit point, at which the cups project downwards, one at a time, from the base.

Preferably there is associated with the station 40 a station 50 (known per se) for delivering plastic stirrer sticks for the drink.

According to the invention there are provided a cup handling device 60 having a gripping member 61 for gripping one cup 8, and means for moving the gripping member 61 in such a manner as to bring it to the various exit points of the delivery stations 20*a*–20*f*, 30, 40 and 50 by a succession of movements.

In the embodiment shown in the figures, the handling device comprises a carriage 65 slidable on parallel guides having their axis extending along said first transverse horizontal direction. The movement is produced by a belt 68 passing endlessly about two pulleys 69, of which one is driven by a geared motor 70 (with encoder).

The carriage 65 carries a second carriage 72 which is movable, relative to the first carriage 65, in a second horizontal direction perpendicular to the first direction. The second carriage 72 carries the gripping member 61.

Specifically, the member 61 comprises a substantially horizontal shank 62, to the front end of which there is fixed a frontally open fork 63 in the form of a circular arc extending through an angle greater than 180 degrees, arranged to embrace and support a cup 8. In this respect, each cup 8 is of frusto-conical shape and comprises an upper rim projecting radially outwards. The fork 63 has an inner diameter such as to embrace as an exact fit the outer surface of the cup, below the rim 8*a*, and to abut against this latter. In addition the front opening of the fork 63 is of such a size that the cup 8, by virtue of its elasticity, can be thrust into the fork by horizontal movement.

The first carriage 65 is substantially in the form of a profiled bar of U cross-section, within which the second carriage 72, in the from of a substantially parallelepiped block, slides. To the carriage 65 there is fixed parallel to the second direction a full-length rack 73 in which there engages a pinion 74 pivoted on a vertical axis to the carriage 72 and driven by a geared motor 75 (with encoder). When operated, the motor 75 causes the second carriage 72 to move in one direction or the other along the first carriage 65.

The rear end of the shank 62 is hinged to the second carriage 72 by a pin of transverse horizontal axis which enables the member 61 to swing in a vertical plane parallel to said second direction. At its front end the first carriage 65 carries a pair of wheels 76 for supporting the shank 62, which is hence supported when in its normal position both by the hinge on the carriage 72 and by the wheels 76, on which the lower surface of the shank 62 normally rests. The shank 62 also possesses on each of its side walls a profiled track 77 for receiving the support wheels 76, it defines a curved path of downwardly facing concavity, which opens at two points on the lower surface 62*a*, of which the front point is closed by a lower blade 78. The track 77 is shaped such that when the gripping member 61 has advanced to its front end position it finally undergoes a lowering from its normal position. In contrast when it withdraws from this advanced position it rises into its normal position only after a delay, so that its return path is different from and lower than its outward path.

This means that when the gripping member 61 has brought the cup 8 into its release location 10, it undergoes lowering so that while the cup rests on the base of the location the fork 63 continues to descend as far as the base of the cup; then when the member 61 is withdrawn rearward, the fork 63 remains in its lowered position for a certain distance sufficient to enable the cup base (the diameter of which is less than the opening in the fork 63 and can hence escape freely from it) to withdraw completely from the fork 63.

Specifically, the track 77 comprises two separate branches 77' and 77", one of them being to the front of and considerably longer than the other, they joining the lower surface of the shank 62 at two different points and both converging into the same rear point 771. The blade 78 is positioned at the point in which the front branch 77' opens into the lower surface 62*a*, in order to enable the relative wheel 76 to leave the branch 77' but to prevent its entry.

Figure 4A:
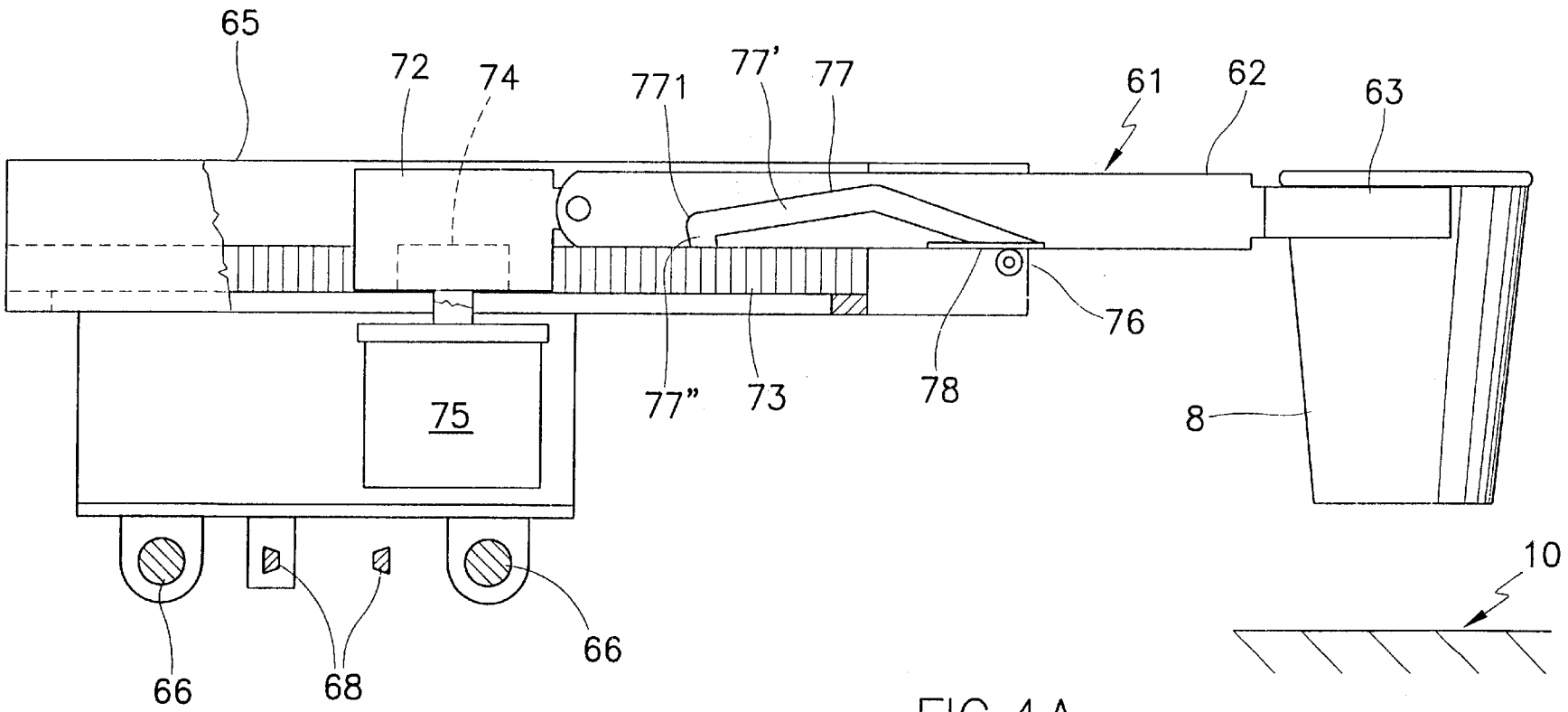
FIG. 4A is a section through the handling device taken on the plane IV—IV of FIG. 3.
Figure 4B:
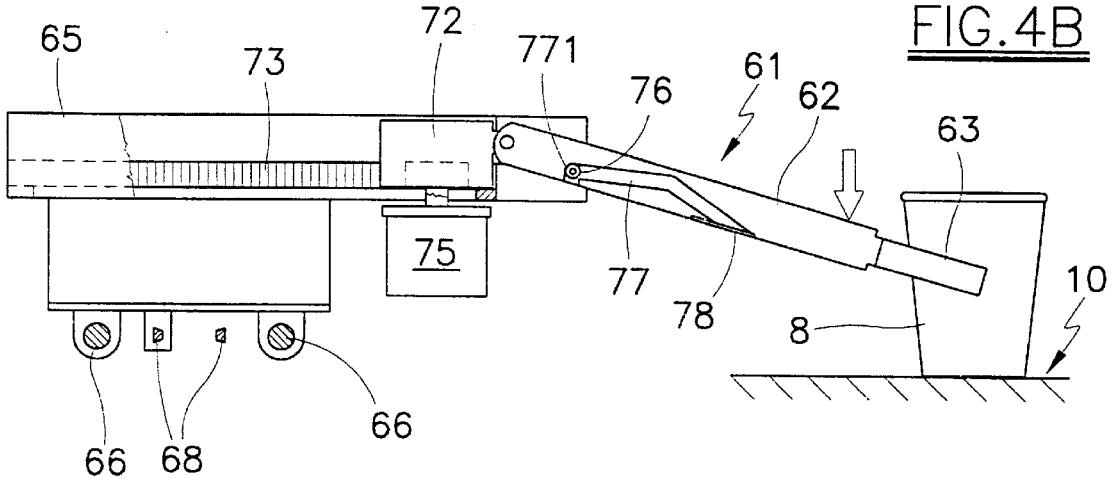
FIGS. 4B, 4C and 4D show the device of FIG. 4A in different positions.
Figure 4C:
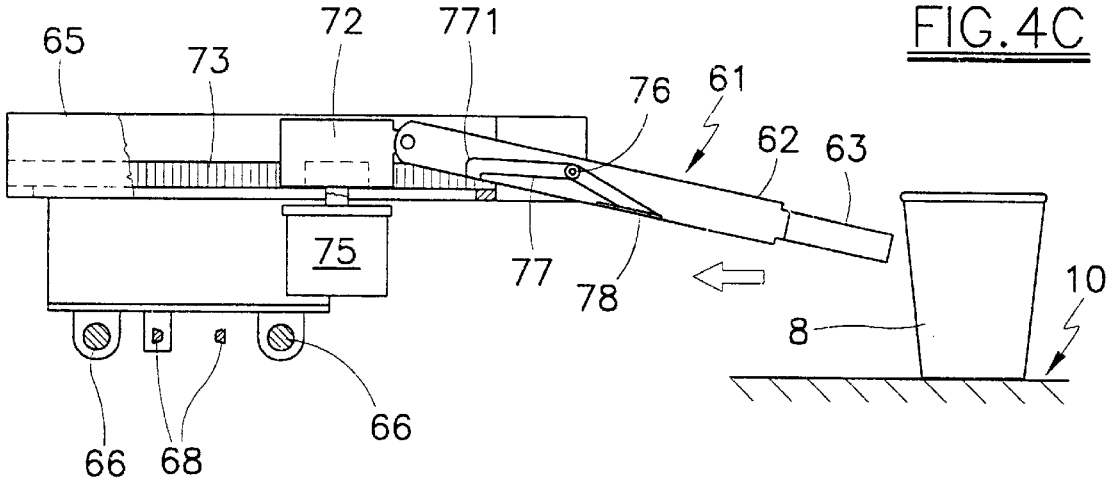
Figure 4D:
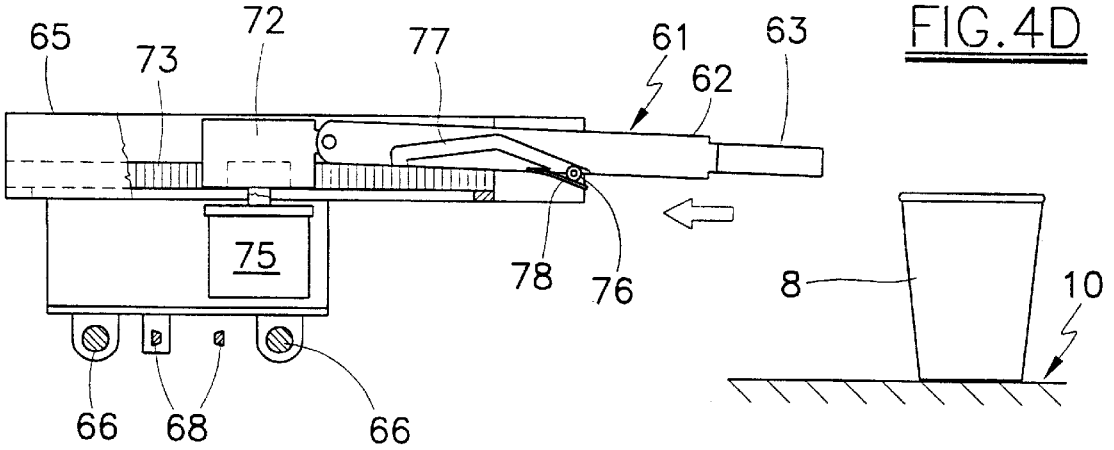

During operation, the wheels 76 normally rest against the lower surface 62*a* along that portion to the front of the track 77. Consequently the member 61 remains in a horizontal raised position. When however the member 61 is moved into its front end position, the wheel 76 firstly slides in contact with the lower surface 62*a*, then enters the rear branch 77"; on passing by the branch 77', the wheel 76 is unable to enter it as it is closed by the blade 78, which lies in a horizontal position and cannot be forced upward (see FIG. 4A). When the member 61 reaches the front end position, the wheel 6 reaches the point 771, and the member 61 moves into its maximum lowered position (see FIG. 4B). When the carriage 72 is withdrawn rearwards, the wheel 76 runs along the upper branch 77' and hence during withdrawal the member 61 remains lower than along its outward path, in which it travels along the branch 77" (see FIG. 4C). Finally, when the wheel reaches the end of the upper branch 77', it freely emerges from this because the blade 78 deflects downward (see FIG. 4D).

As in traditional dispensers, the automatic dispenser of the invention comprises an automatic electrical/electronic control unit (known per se and not shown in the figures) which, on insertion of a coin (or equivalent) and on the basis of the user's choice, controls the succession of operations involved in the emission of substances by the stations 20*a*–20*f*, 30, and cups and stirrer sticks by the stations 40 and 50.

Figure 3:
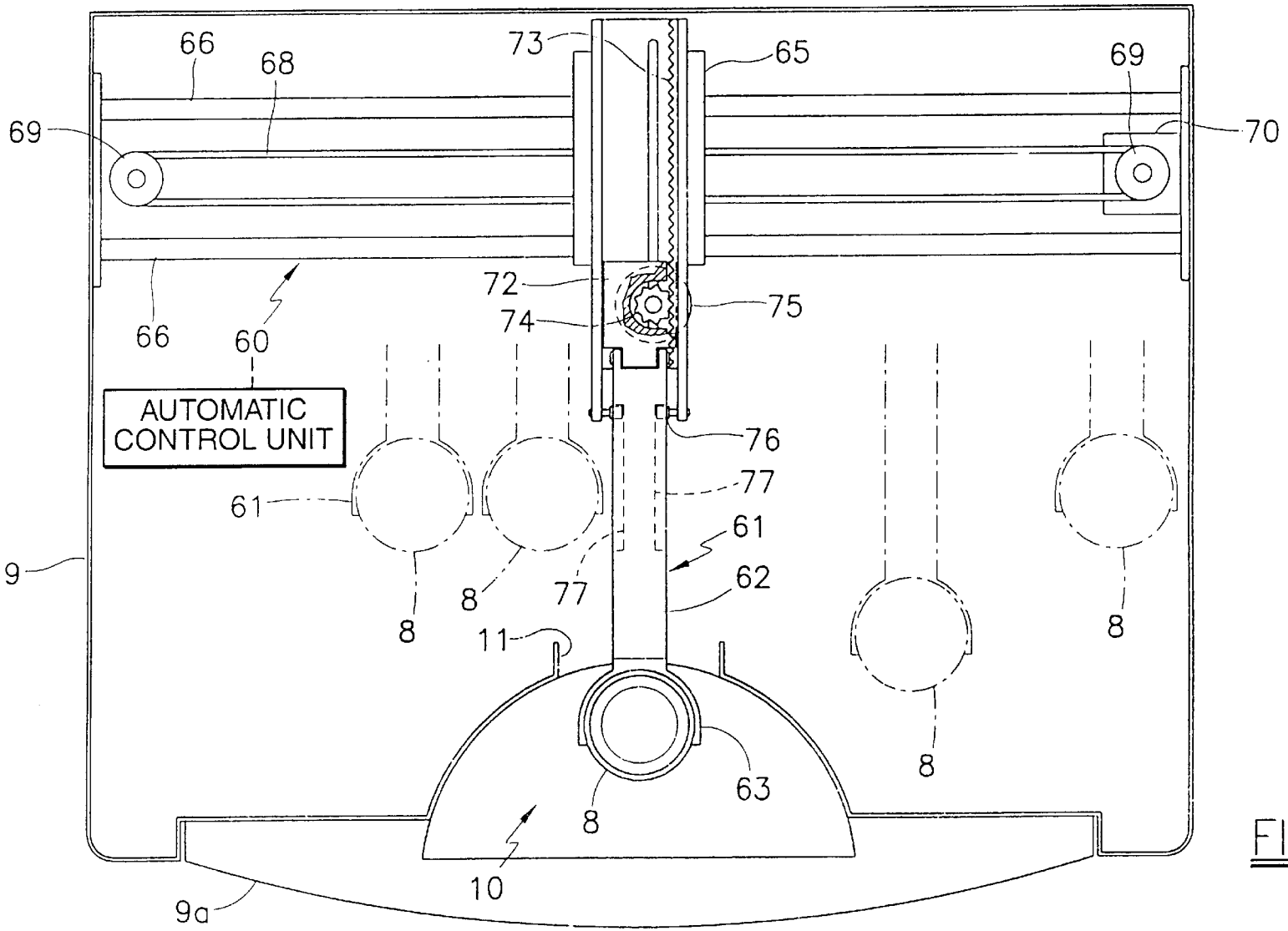
FIG. 3 is a section on the horizontal plane II—II of FIG. 2.

The automatic control unit also controls the operation of the handling device 60 in a manner coordinated with the operation of the other members of the dispenser, on the basis of the choice made by the use. Specifically, the device 60 is controlled in such a manner as to firstly bring the gripping member to the cup delivery station in order to grip one cup, then bring the gripped cup under the exit points 25 of those delivery stations 20*a*–20*f* chosen on the basis of the user's requirements, then possibly bring the cup under the stick delivery station 50, and finally bring the cup into the drink release location 10. FIG. 3 shows by dashed lines some possible positions assumed by the cup brought by the device 60 to below the delivery stations.

By virtue of the invention those relatively lengthy pipes which in known automatic dispensers convey the substance leaving the station exit points to the cup positioned in the release location are eliminated. Hence the aforesaid drawbacks connected with the presence of these pipes are overcome, so eliminating the problem of effectively cleaning these pipes and the problem of foreign substances dripping into the drink, and enabling material in powder form such as chocolate, or even solid objects, to be fed into the drink. Finally, there are no limits to the number of delivery stations which can be used.

In an alternative embodiment, the stations 20*a*–20*f* are arranged to deliver the substances present in their vessels 21 directly into the cup, as material in soluble powder form. A means is also provided to deliver into the cup a jet of hot or cold water or other liquid able to dissolve these substances directly in the cup. In this case the mixing devices 23 and the relative delivery spouts 25 are eliminated, hence further improving the hygiene of the machine and of the substances delivered, and reducing the amount of cleaning required for the parts which come into contact with the drinks.

Numerous modifications of a practical and applicational nature can be made to the invention, but without leaving the scope of the inventive idea as claimed hereinafter.

What is claimed is:

1. An automatic cupped drinks dispenser, comprising:

a plurality of delivery stations for the constituent substances of the drink, a delivery station for empty cups, a location in which the drink contained in the cup is released to the user, an automatic control unit which automatically controls the succession of operations involved in emitting the substances and cups, comprising a cup handling device comprising a gripping member for gripping a cup, and means for moving said gripping member in such a manner as to bring it, by a succession of movements, to exit points of the delivery stations, said handling device being controlled by the automatic control unit in such a manner as to firstly bring the gripping member to the delivery station for empty cups in order to grip one of them, then bring the gripped cup under the exit points of the other delivery stations, and finally bring the cup carrying the drink into the location for its release to the user, wherein the gripping member has a shank hinged to a carriage movable in a horizontal direction, the shank possessing a profiled track which receives support wheels for the shank and defines, closed by a lower blade, a path which is such that when the gripping member has advanced to a front end position it finally undergoes a lowering from a normal position, whereas when it withdraws from this end position the gripping member rises into its normal position only after a delay, so that its return path is different from and lower than an outward path.

2. An automatic dispenser as claimed in claim 1, wherein the substance exit points of the delivery stations are arranged substantially in the same ideal plane, below which and at a short distance therefrom the gripping member moves.

3. The automatic dispenser as claimed in claim 1, wherein said cup handling device comprises a first carriage slidable in a first horizontal direction and carrying a second carriage, which is movable relative to the first carriage in a horizontal direction perpendicular to the first direction, and carries the gripping member, the gripping member being hinged to the second carriage through the rear end of its shank, and said first carriage carrying the pair of shank support wheels for the profiled track of the shank.

4. The automatic dispenser as claimed in claim 1, wherein the stations are arranged to deliver the substances present in vessels 21 directly into the cup, as material in soluble powder form; there also being provided a means to deliver into the cup a jet of hot or cold water or other liquid able to dissolve these substances directly in the cup.

* * * * *